US005941231A

United States Patent [19]

Garrett et al.

[11] Patent Number: 5,941,231

[45] Date of Patent: Aug. 24, 1999

[54] VERTICAL OR HORIZONTAL VENT ASSEMBLY

[75] Inventors: Michael K. Garrett; Mark R. Bolduc, both of El Paso, Tex.

[73] Assignee: AOS Holding Company, Wilmington, Del.

[21] Appl. No.: 08/946,630

[22] Filed: Oct. 7, 1997

[51] Int. Cl.[6] ..... F24C 3/00

[52] U.S. Cl. ..... 126/85 B; 126/512; 126/307; 126/315; 126/361; 285/183

[58] Field of Search ..... 126/307 R, 315, 126/512, 85 B, 361; 122/16, 19 R, 262, 264; 285/179, 2, 183, 184

[56] References Cited

U.S. PATENT DOCUMENTS

| | | | |
|---|---|---|---|
| 24,834 | 7/1859 | Turner | 285/184 |
| 24,840 | 7/1859 | Bedell | 285/183 |
| 36,911 | 11/1862 | Parse | 285/183 |
| 76,812 | 4/1868 | Recht | 285/183 |
| 101,603 | 4/1870 | Field | 285/184 |
| 783,987 | 2/1905 | Walsh | 285/184 |
| 1,179,995 | 4/1916 | Beckwith . | |
| 2,392,220 | 1/1946 | Bruhn et al. | 285/211 |
| 2,482,558 | 9/1949 | Scaringella | 285/211 |
| 2,828,723 | 4/1958 | Miller | 122/264 |
| 3,848,308 | 11/1974 | Kaval | 29/157 A |
| 4,191,163 | 3/1980 | Ballard | 126/514 |
| 4,204,518 | 5/1980 | Smith | 126/514 |
| 5,320,086 | 6/1994 | Beal et al. | 126/512 |
| 5,462,043 | 10/1995 | Rose et al. | 126/77 |
| 5,482,028 | 1/1996 | Binzer | 126/85 B |
| 5,590,641 | 1/1997 | Duong | 126/85 B |
| 5,647,341 | 7/1997 | Langman et al. | 126/512 |

*Primary Examiner*—Carroll B. Dority
*Attorney, Agent, or Firm*—Michael Best & Friedrich LLP

[57] ABSTRACT

A gas combustion apparatus including a housing having a top wall and a side wall, the top wall and the side wall defining vertical and horizontal openings, respectively, and the housing defining a combustion chamber having an exhaust opening; a burner mounted in the combustion chamber; and a vent assembly for venting exhaust gases generated by the burner to either the vertical or the horizontal opening, the vent assembly including two substantially identical vent conduits, each of the vent conduits having a central axis, a first end defined by a first continuous edge lying in a plane perpendicular to the central axis, and a second end defined by a second continuous edge lying in a plane at a forty-five degree angle to the central axis, the second ends of the vent conduits being connected together with the central axes of the conduits aligned to conduct exhaust gases between the exhaust opening and one of the vertical opening and the horizontal opening, and the second ends of the conduits being connected together with the central axes of the conduits perpendicular to conduct exhaust gases between the exhaust opening and the other of the vertical opening and the horizontal opening.

21 Claims, 2 Drawing Sheets

VERTICAL OR HORIZONTAL VENT ASSEMBLY

BACKGROUND OF THE INVENTION

The invention relates to an apparatus for venting exhaust gases from a combustion chamber in a gas combustion apparatus such as a gas boiler, furnace or water heater.

It is commonly known in the art to provide gas boilers, water heaters and furnaces with a combustion chamber and a heat exchanger for transferring heat generated by the combustion of fuel in the combustion chamber to a substance such as water or air passing through the heat exchanger. Because the device is usually installed inside a building, it is necessary to provide a conduit or exhaust vent to remove the exhaust gases from the combustion chamber. The exhaust vent is usually connected to a network of pipes that eventually vents outside the building where the exhaust gases disburse to the atmosphere.

SUMMARY OF THE INVENTION

Because of the many different environments in which the devices are installed, it is ideal to have a gas boiler, water heater or furnace that is very flexible in that it can be configured in a number of different ways to connect to the exhaust network.

Accordingly, the invention provides an apparatus for providing an alternative vertical or horizontal vent to remove exhaust gases from the combustion chamber of a gas combustion apparatus. More particularly, the invention provides a gas combustion apparatus comprising a housing having a top wall and a side wall. The top wall and the side wall define vertical and horizontal openings, respectively. The housing also defines a combustion chamber having an exhaust opening. The apparatus also comprises a burner mounted in the combustion chamber, and a vent assembly for venting exhaust gases generated by the burner to either the vertical opening or the horizontal opening. The vent assembly includes two substantially identical vent conduits. Each of the vent conduits has a central axis, a first end defined by a first continuous edge lying in a plane perpendicular to the central axis, and a second end defined by a second continuous edge lying in a plane at a forty-five degree angle to the central axis. The second ends of the vent conduits are connected together with the central axes of the conduits aligned to conduct exhaust gases between the exhaust opening and one of the vertical and horizontal openings, preferably the vertical opening, and the second ends of the conduits are connected together with the central axes of the conduits perpendicular to conduct exhaust gases between the exhaust opening and the other of the vertical and horizontal openings, preferably the horizontal opening.

The invention also provides a gas combustion apparatus comprising a housing defining a combustion chamber having an exhaust outlet. The housing has a top wall and a side wall, the top wall having therein a top exhaust opening, and the side wall having therein a side exhaust opening. The apparatus also comprises a burner in the combustion chamber, and an internal vent assembly having one end connected to the combustion chamber exhaust outlet and having an other end selectively and alternatively connectable to either the top opening or the side opening for conducting exhaust gases from the combustion chamber exhaust outlet to either the top opening or the side opening.

Other features and advantages of the invention will become apparent to those skilled in the art upon review of the following detailed description, claims and drawings.

Figure 1:
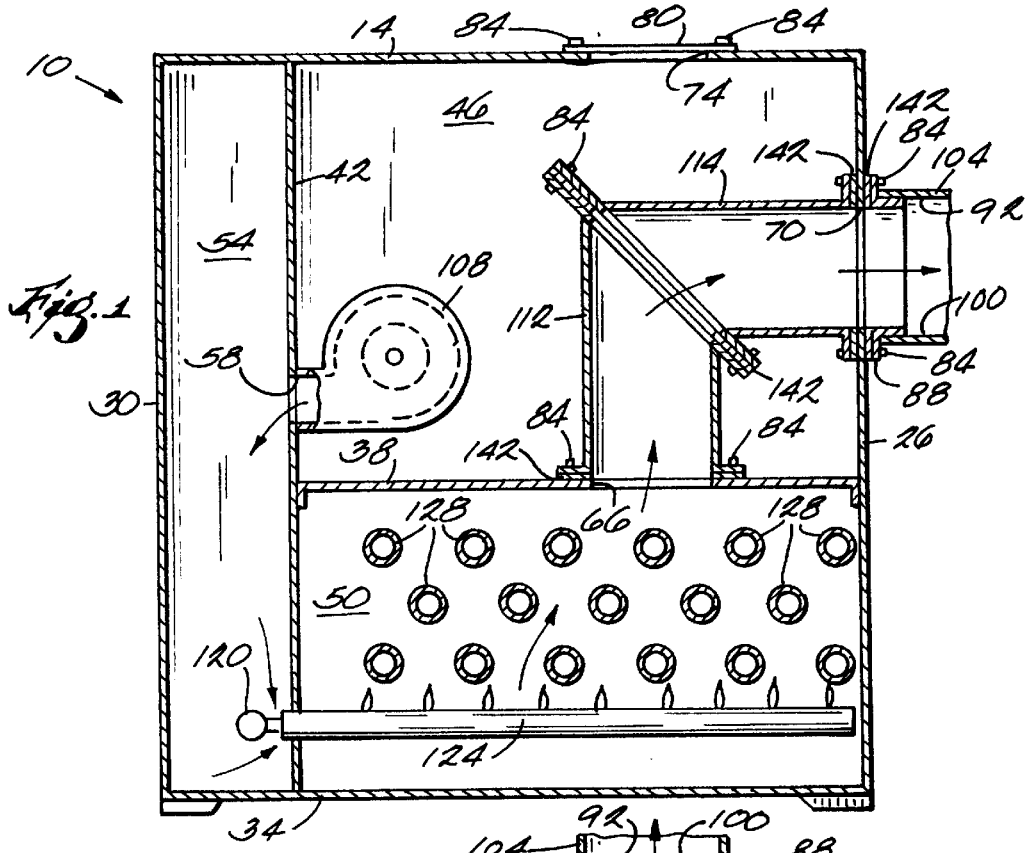
FIG. 1 is a cross sectional view of a gas boiler which embodies the invention and which has an exhaust vent pipe configured to vent gases in the horizontal direction.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENTS

Illustrated in FIG. 1 is a gas combustion apparatus 10 embodying the invention. While the invention is described in the context of a gas boiler or water heater, it should be understood that the invention is applicable to any type of gas combustion apparatus. The apparatus 10 comprises a top wall 14, side walls 18, 22, 26, and 30, and a bottom wall 34. The interior of the apparatus 10 is subdivided into three chambers by a horizontal dividing wall 38 and a vertical dividing wall 42. An ambient air chamber 46 is defined by the walls 14, 18, 22, 26, 38, and 42. A combustion chamber 50 is defined by the walls 18, 22, 26, 34, 38, and 42. A pressurized inlet chamber 54 is defined by the walls 14, 18, 22, 30, 34, and 42.

Figure 2:
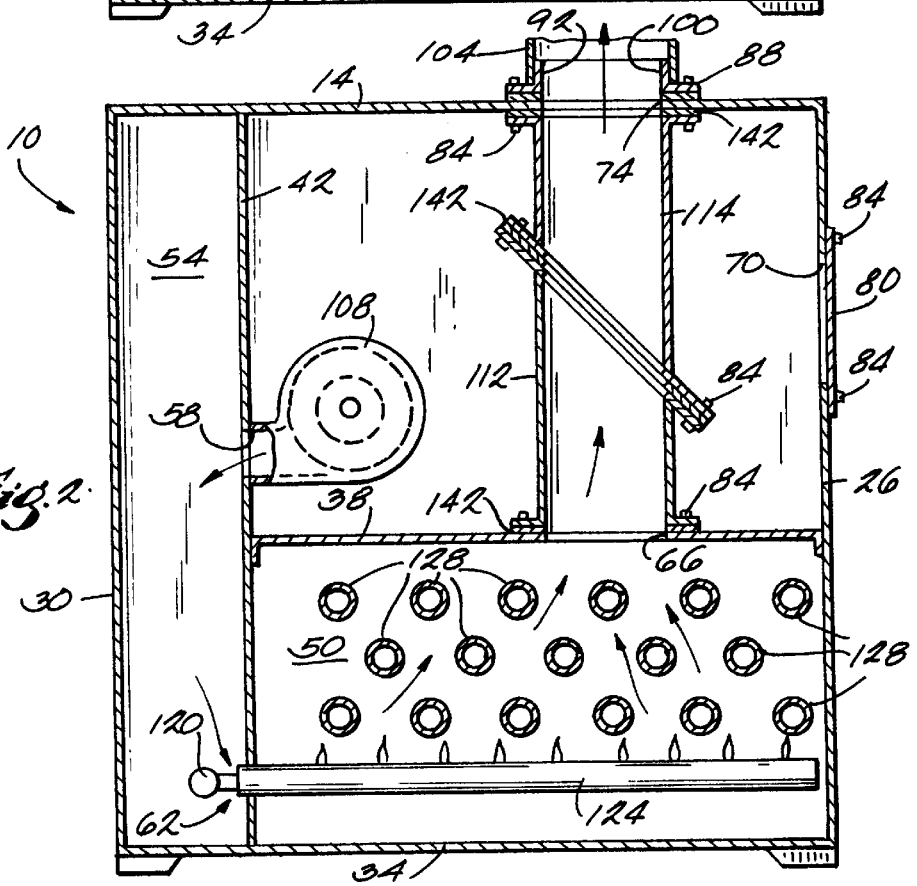
FIG. 2 is a cross sectional view of the gas boiler with the exhaust vent pipe configured to vent gases in the vertical direction.

Vertical dividing wall 42 defines an inlet chamber opening 58 and a plurality of burner inlets 62. Horizontal dividing wall 38 defines a combustion chamber exhaust opening 66. Side wall 26 defines a generally rectangular side opening 70. Top wall 14 defines a generally rectangular top opening 74 substantially identical in size and shape to side opening 70. At any one time, either side opening 70 or top opening 74 is not used and is covered by a cover plate 80 that substantially covers the opening and is fastened to the wall 14 or 26 using bolts or screws 84. In FIG. 1 cover plate 80 is shown covering top opening 74. In FIG. 2 cover plate 80 is shown covering side opening 70.

Figure 4:
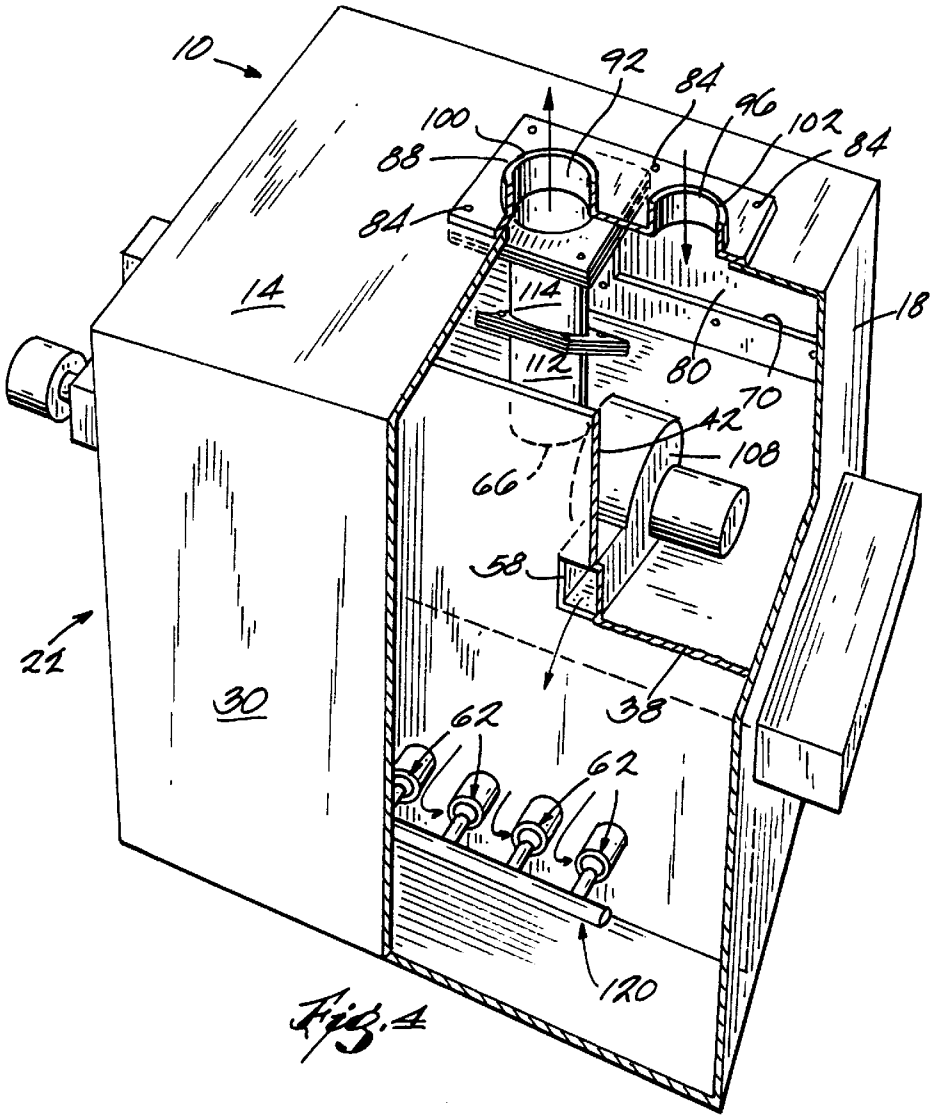
FIG. 4 is a perspective view of the water heater with portions cut-away.

As best shown in FIG. 4, the opening 70 or 74 that is not covered by cover plate 80 is covered by a generally rectangular vent plate 88 defining a vent pipe opening 92 and an ambient air opening 96 (FIG. 4 only). Openings 92 and 96 are generally circular and are respectively defined by collars 100 and 102. Collar 100 is used to interface with an exhaust pipe 104 (FIGS. 1 and 2) communicating with vent pipe opening 92.

A gas supply conduit 120 is located in pressurized inlet chamber 54. The gas supply conduit 120 communicates with the burner inlets 62 to supply gas or other combustible fuel to a plurality of burners 124 (FIGS. 1 and 2) in combustion chamber 50. The apparatus 10 also includes a plurality of water tubes 128 connected to a conventional water supply (not shown). The water tubes 128 pass through combustion chamber 50 so that the water tubes 128 are in close proximity to the burners 124. As is commonly known in the art, combustion of fuel at the burners 124 generates heat to heat the water in the water tubes 128.

The apparatus 10 also includes an inlet fan 108 mounted in ambient air chamber 46. Inlet fan 108 communicates with pressurized inlet chamber 54 through inlet chamber opening 58. The inlet fan 108 aids in moving gases through the apparatus 10. Specifically, inlet fan 108 generates air flow from opening 96 into ambient air chamber 46 and pushes pressurized air through inlet chamber opening 58 into pressurized inlet chamber 54. The pressurized air in pressurized inlet chamber 58 passes through burner inlets 62 and is at least partially consumed in the combustion chamber 50 in the combustion reaction with the fuel. The exhaust gases from the combustion reaction flow out of the combustion chamber 50 through exhaust opening 66.

The apparatus 10 also includes vent pipes or conduits 112 and 114. The vent pipes 112 and 114 are identical, and accordingly, only the vent pipe 112 will be described in detail. Like parts are given like reference numerals.

Figure 3:
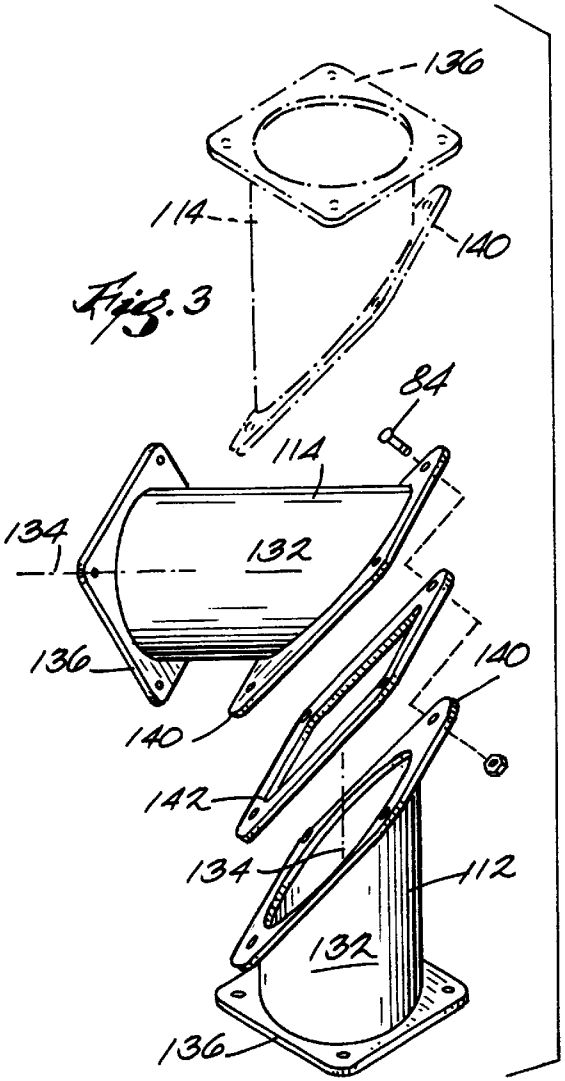
FIG. 3 is an exploded perspective view of the exhaust vent pipe showing two possible configurations.

As best shown in FIG. 3, vent pipe 112 includes a cylinder 132 having a central axis 134, a flanged first end 136 lying generally in a plane perpendicular to the central axis 134, and a flanged second end 140 lying generally in a plane at approximately a forty-five degree angle to the central axis 134. As shown in FIGS. 1, 2 and 3, there are two possible configurations for connecting vent pipe assemblies 112 and 114 together. Flanged first end 136 of vent pipe assembly 112 connects to exhaust opening 66. Flanged second end 140 of vent pipe assembly 112 is connected to flanged second end 140 of vent pipe assembly 114 so as to form either a 90° angle elbow pipe, with the axes 134 of the pipes 112 and 114 perpendicular as shown in FIG. 1, for horizontal venting, or a straight pipe, with the axes 134 aligned as shown in FIG. 2, for vertical venting.

FIG. 3 illustrates the manner in which a vent pipe gasket 142 is sandwiched between the flanged second ends 140 of vent pipes 112 and 114. All three parts are fastened together, using bolts or screws 84, to form a continuous pipe. The vent pipe gasket 142 provides a substantially air-tight seal so that dangerous exhaust gases do not escape into ambient air chamber 46 and out of the apparatus 10 through ambient air opening 96. A vent pipe gasket 142 similarly provides an air-tight seal at the interface between horizontal dividing wall 38 and flanged first end 136 of vent pipe assembly 112. In the configuration shown in FIG. 1, air-tight seals are also provided, using vent pipe gaskets 142, between flanged first end 136 of vent pipe assembly 114 and the interior surface of right side wall 26 and between the exterior surface of right side wall 26 and vent plate 88. Similarly, in the configuration shown in FIG. 2, air-tight seals are also provided, using vent pipe gaskets 142, between flanged first end 136 of vent pipe assembly 114 and the interior surface of top wall 14 and between the exterior surface of top wall 14 and vent plate 88. All of the connections of vent pipe assembly 112 and 114 with other interfaces are substantially fastened using bolts or screws 84. Both the vent pipe configuration shown in FIG. 1 and the configuration shown in FIG. 2 use two identical vent pipes 112 and 114 to create a continuous pipe from exhaust opening 66 to side opening 70 or top opening 74.

FIGS. 1, 2, and 4 illustrate how gases flow through the apparatus 10. Ambient air enters ambient air chamber 46 through ambient air opening 96, located over either side opening 70, as illustrated in FIG. 1, or over top opening 74, as illustrated in FIG. 2. Inlet fan 108 blows air from ambient air chamber 46 into pressurized air chamber 54 through inlet chamber opening 58. The pressurized air, contained in pressurized inlet chamber 54, flows through burner inlets 62 due to a pressure differential between pressurized inlet chamber 54 and combustion chamber 50. The pressurized air is mixed with combustible gas delivered by gas supply 120. The gas-air mixture is combusted in burners 124. Heat from the combustion reaction is transferred to conductive water tubes 128, contained within combustion chamber 50. The heat is transferred through the walls of water tubes 128 to water flowing through water tubes 128. Exhaust combustion gases flow through exhaust opening 66 into vent pipes 112 and 114. Finally, the exhaust gases flow out of the apparatus 10 through vent pipe opening 92 in either side opening 70, as illustrated in FIG. 1, or top opening 74, as illustrated in FIG. 2.

Alternative to the preferred embodiment shown in FIGS. 1 and 2, the side opening may be located in either side wall 18 or side wall 22 instead of side wall 26. The bolts or screws 84 may be replaced with other suitable fasteners including but not limited to rivets, sheet metal screws, or welded seams.

The apparatus 10 is a reconfigurable device which allows exhaust gases to exit through either top opening 74 or side opening 70 without requiring any extra parts for reconfiguration. Identical vent pipes 112 and 114 are used in both configurations, shown in FIGS. 1 and 2, and vent plate 88 and cover plate 80 are also both used in both configurations.

It is recognized that various equivalents, alternatives and modifications are possible within the scope of the appended claims.

What is claimed is:

1. A gas combustion apparatus comprising:

a housing having a top wall and a side wall, said top wall and said side wall defining vertical and horizontal openings, respectively, and said housing defining a combustion chamber having an exhaust opening;

a burner mounted in said combustion chamber; and a vent assembly for venting exhaust gases generated by said burner to either said vertical opening or said horizontal opening, said vent assembly including two substantially identical vent conduits, each of said vent conduits having a central axis, a first end defined by a first continuous edge lying in a plane perpendicular to said central axis, and a second end defined by a second continuous edge lying in a plane at a forty-five degree angle to said central axis, said second ends of said vent conduits being connected together with the central axes of said conduits aligned when said conduits are arranged to conduct exhaust gases between said exhaust opening and one of said vertical opening and said horizontal opening, and said second ends of said conduits being connected together with the central axes of said conduits perpendicular when said conduits are arranged to conduct exhaust gases between said exhaust opening and the other of said vertical opening and said horizontal opening.

2. An apparatus as set forth in claim 1 wherein said second continuous edge is a flange for connecting said second ends of said conduits together.

3. An apparatus as set forth in claim 1 wherein said first continuous edge is a flange for connecting said first ends of said conduits to said housing.

4. An apparatus as set forth in claim 1 and further comprising a gasket connected between said second ends.

5. An apparatus as set forth in claim 1 and further comprising a fan mounted on said housing for forcing air into said combustion chamber.

6. An apparatus as set forth in claim 1 and further comprising a water conduit extending through said combustion chamber so that water in said water conduit is heated during combustion of fuel by said burner.

7. An apparatus as set forth in claim 1 wherein said vent assembly further comprises a vent plate connected to either said top wall or said side wall, said vent plate covering the associated one of said vertical opening and said horizontal opening, said vent plate defining a vent pipe opening communicating with one of said vent conduits.

8. An apparatus as set forth in claim 7 wherein said vent plate also defines an ambient air opening.

9. A gas combustion apparatus comprising:

a housing defining a combustion chamber having an exhaust outlet, said housing having a top wall and a side wall, said top wall having therein a top exhaust opening, and said side wall having therein a side exhaust opening;

a burner in said combustion chamber for burning fuel and generating heat and exhaust gas as a result of burning fuel; and an internal vent assembly having one end connected to said combustion chamber exhaust outlet and having an other end selectively and alternatively connectable to either said top opening or said side opening for conducting exhaust gases from said combustion chamber exhaust outlet to either said top opening or said side opening, said vent assembly including two substantially identical vent conduits, each of said vent conduits having a central axis, a first end defined by a first continuous edge lying in a plane perpendicular to said central axis, and a second end defined by a second continuous edge lying in a plane at a forty-five degree angle to said central axis.

10. An apparatus as set forth in claim 9 wherein said second ends of said vent conduits are connected together.

11. An apparatus as set forth in claim 10 wherein said second ends of said vent conduits are connected together with the central axes of said conduits aligned when said conduits are arranged to conduct exhaust gases between said exhaust outlet and one of said top opening and said side opening, and said second ends of said conduits being connected together with the central axes of said conduits perpendicular when said conduits are arranged to conduct exhaust gases between said exhaust opening and the other of said top opening and said side opening.

12. An apparatus as set forth in claim 10 wherein said second continuous edge is a flange for connecting said second ends of said conduits together.

13. An apparatus as set forth in claim 10 wherein said first continuous edge is a flange for connecting said first ends of said conduits to said housing.

14. An apparatus as set forth in claim 10 and further comprising a gasket connected between said second ends.

15. An apparatus as set forth in claim 9 and further comprising a fan mounted on said housing for forcing air into said combustion chamber.

16. An apparatus as set forth in claim 9 and further comprising a water conduit extending through said combustion chamber so that water in said water conduit is heated during combustion of fuel by said burner.

17. An apparatus as set forth in claim 9 wherein said vent assembly further comprises a vent plate connected to either said top wall or said side wall, said vent plate covering the associated one of said top opening and said side opening, said vent plate defining a vent pipe opening communicating with one of said vent conduits.

18. An apparatus as set forth in claim 17 wherein said vent plate also defines an ambient air opening.

19. A gas boiler comprising:

a housing having a top wall and a side wall partially defining an ambient air chamber, said top wall and said side wall defining top and side openings, respectively, and said housing including a horizontal dividing wall partially defining a combustion chamber beneath said ambient air chamber, said horizontal dividing wall defining a combustion chamber exhaust opening;

a burner mounted in said combustion chamber for burning fuel and generating heat and exhaust gas as a result of burning of fuel;

a water conduit extending through said combustion chamber so that heat generated by said burner is transferred to water in said water conduit;

a vent assembly located in said ambient air chamber for conducting exhaust gases from said combustion chamber exhaust opening to either said top opening or said side opening, said vent assembly including two substantially identical vent conduits, each of said vent conduits having a central axis, a first end defined by a first continuous edge lying in a plane perpendicular to said central axis, and a second end defined by a second continuous edge lying in a plane at a forty-five degree angle to said central axis, said second ends of said vent conduits being connected together with the central axes of said conduits aligned when said conduits are arranged to conduct exhaust gases between said exhaust opening and said top opening, and said second ends of said conduits being connected together with the central axes of said conduits perpendicular when said conduits are arranged to conduct exhaust gases between said combustion chamber exhaust opening and said side opening, said vent assembly further comprising a vent plate connected to either said top wall or said side wall, said vent plate covering the associated one of said top opening and said side opening, said vent plate defining a vent pipe opening communicating with one of said vent conduits, and said vent assembly further comprising a cover plate covering the one of said top opening and said side opening not being used to conduct exhaust gases.

20. An apparatus as set forth in claim 7 and further comprising a cover plate covering the other one of said vertical opening and said horizontal opening.

21. An apparatus as set forth in claim 17 and further comprising a cover plate covering the other one of said top opening and said side opening.

* * * * *